US009068456B2

(12) United States Patent
Yarr

(10) Patent No.: US 9,068,456 B2
(45) Date of Patent: Jun. 30, 2015

(54) FLUID ENERGY TRANSFER DEVICE WITH IMPROVED BEARING ASSEMBLIES

(75) Inventor: George A. Yarr, Ballston Spa, NY (US)

(73) Assignee: ENER-G-ROTORS, INC., Schenectady, NY (US)

( * ) Notice: Subject to any disclaimer, the term of this patent is extended or adjusted under 35 U.S.C. 154(b) by 105 days.

(21) Appl. No.: 13/695,967

(22) PCT Filed: May 5, 2011

(86) PCT No.: PCT/US2011/035383
§ 371 (c)(1),
(2), (4) Date: Nov. 2, 2012

(87) PCT Pub. No.: WO2011/140358
PCT Pub. Date: Nov. 10, 2011

(65) Prior Publication Data

US 2013/0045125 A1 Feb. 21, 2013

Related U.S. Application Data

(60) Provisional application No. 61/331,572, filed on May 5, 2010.

(51) Int. Cl.
*F01C 1/10* (2006.01)
*F04C 2/14* (2006.01)
(Continued)

(52) U.S. Cl.
CPC ..... *F01C 1/103* (2013.01); *F01C 11/002* (2013.01); *F01C 21/02* (2013.01); *F04C 2/14* (2013.01); *F04C 2210/24* (2013.01)

(58) Field of Classification Search
CPC ..... F01C 1/103
USPC ..... 418/171, 161, 160
See application file for complete search history.

(56) References Cited

U.S. PATENT DOCUMENTS 2,753,810 A 7/1956 Quintilian
3,680,989 A 8/1972 Brundage
(Continued)

FOREIGN PATENT DOCUMENTS

CH 358540 A 11/1961
DE 233423 C 5/1925
(Continued)

OTHER PUBLICATIONS

International Search Report and Written Opinion for International Application No. PCT/US2011/035383 dated Dec. 19, 2011, 8 pages.
(Continued)

*Primary Examiner* — Mary A Davis
(74) *Attorney, Agent, or Firm* — Goodwin Procter LLP

(57) ABSTRACT

A trochoidal gear pump or engine uses a coaxial hub with an outer and/or inner rotor and an associated rolling element bearing assembly that uses pre-loaded bearings to precisely set the rotational axis and/or the axial position of the rotor with which it is associated. This allows the fixed-gap clearance between the rotor surfaces and the housing or other rotor surfaces to be set at a distance that minimizes operating fluid shear forces and/or by-pass leakage and eliminates gear tooth wear thus preserving effective chamber to chamber sealing. The device is useful in handling gaseous and two-phase fluids in expansion/contracting fluid engines/compressors and can incorporate an output shaft for an integrated condensate pump for use with Rankine cycles. A vent from the housing cavity to a lower pressure input or output port regulates built-up fluid pressure in the housing, thereby optimizing the efficiency of the device by controlling bypass leakage.

22 Claims, 12 Drawing Sheets

(51) Int. Cl.
*F01C 11/00* (2006.01)
*F01C 21/02* (2006.01)

(56) References Cited

U.S. PATENT DOCUMENTS

| | | | |
|---|---|---|---|
| 3,750,393 | A | 8/1973 | Minto et al. |
| 3,824,044 | A | 7/1974 | Hinckley |
| 3,905,727 | A | 9/1975 | Kilmer |
| 3,907,470 | A | 9/1975 | Harle et al. |
| 3,910,732 | A | 10/1975 | Lusztig |
| 4,025,243 | A | 5/1977 | Stephens |
| 4,044,562 | A | 8/1977 | England |
| 4,181,479 | A | 1/1980 | Ross |
| 4,253,807 | A | 3/1981 | Pahl |
| 4,457,677 | A | 7/1984 | Todd |
| 4,480,972 | A | 11/1984 | Zumbusch |
| 4,484,870 | A | 11/1984 | Erasov |
| 4,492,539 | A | 1/1985 | Specht |
| 4,519,755 | A | 5/1985 | Hanson |
| 4,526,518 | A | 7/1985 | Wiernicki |
| 4,533,302 | A | 8/1985 | Begley |
| 4,545,748 | A | 10/1985 | Middlekauff |
| 4,557,112 | A | 12/1985 | Smith |
| 4,569,644 | A | 2/1986 | Swedberg |
| 4,586,875 | A | 5/1986 | Aman, Jr. |
| 4,673,342 | A | 6/1987 | Saegusa |
| 4,747,744 | A | 5/1988 | Dominique et al. |
| 4,881,880 | A | 11/1989 | Dlugokecki |
| 4,894,994 | A | 1/1990 | Carter |
| 4,940,401 | A | 7/1990 | White, Jr. |
| 5,017,101 | A | 5/1991 | White |
| 5,062,776 | A | 11/1991 | Dlugokecki |
| 5,114,324 | A | 5/1992 | Spindeldreher |
| 5,165,238 | A | 11/1992 | Paul et al. |
| 5,195,882 | A | 3/1993 | Freeman |
| 5,328,343 | A | 7/1994 | Bernstrom et al. |
| 5,410,998 | A | 5/1995 | Paul et al. |
| 5,439,357 | A | 8/1995 | Barthod et al. |
| 5,472,329 | A | 12/1995 | Maynard et al. |
| 5,569,024 | A | 10/1996 | Dummersdorf et al. |
| 5,711,660 | A | 1/1998 | Mitarai et al. |
| 5,722,815 | A | 3/1998 | Cozens |
| 5,762,101 | A | 6/1998 | Burke et al. |
| 6,114,324 | A | 9/2000 | Skrabanja et al. |
| 6,174,151 | B1 | 1/2001 | Yarr |
| 6,474,751 | B1 | 11/2002 | Yamaguchi et al. |
| 6,905,321 | B2 | 6/2005 | Uchiyama |
| 7,427,192 | B2 | 9/2008 | Lampanski et al. |
| 7,503,757 | B2 | 3/2009 | Ono et al. |
| 8,360,762 | B2 | 1/2013 | Nunami et al. |
| 8,714,951 | B2 * | 5/2014 | Yarr ..... 418/171 |
| 2007/0237665 | A1 | 10/2007 | Holtzapple et al. |
| 2008/0145259 | A1 | 6/2008 | Nakakuki et al. |

FOREIGN PATENT DOCUMENTS

| | | | |
|---|---|---|---|
| DE | 547826 | C | 5/1932 |
| DE | 871822 | C | 7/1961 |
| DE | 928239 | C | 6/1963 |
| DE | 4107704 | A1 | 9/1991 |
| EP | 1380754 | A2 | 1/2004 |
| GB | 233423 | | 5/1925 |
| GB | 871822 | | 7/1961 |
| GB | 928239 | | 6/1963 |
| JP | 10331777 | | 12/1998 |

OTHER PUBLICATIONS

European Office Action for 11778359.7 dated Mar. 14, 2014, 7 pages.
International Search Report and Written Opinion for International Application No. PCT/US2012/049567 dated Oct. 4, 2013, 12 pages.

* cited by examiner

FLUID ENERGY TRANSFER DEVICE WITH IMPROVED BEARING ASSEMBLIES

CROSS-REFERENCE TO RELATED APPLICATIONS

The subject matter of this application relates to U.S. Pat. No. 6,174,151, the entire disclosure of which is hereby incorporated herein by reference in its entirety. This application is a national stage entry of International Patent Application No. PCT/US2011/035383, filed May 5, 2011, which claims priority to and the benefit of U.S. Provisional Patent Application Ser. No. 61/331,572, filed on May 5, 2010, the disclosures of which are hereby incorporated herein by reference in their entirety

FIELD OF THE INVENTION

The present invention relates to energy transfer devices that operate on the principal of intermeshing trochoidal gear fluid displacement and more particularly to the reduction of frictional forces in such systems.

BACKGROUND OF THE INVENTION

Trochoidal gear, fluid displacement pumps and engines are well-known in the art. In general, a lobate, eccentrically-mounted, inner male rotor interacts with a mating lobate female outer rotor in a close-fitting chamber formed in a housing with a cylindrical bore and two end plates. The eccentrically mounted inner rotor gear has a set number of lobes or teeth and cooperates with a surrounding outer lobate rotor, i.e., ring gear, with one additional lobe or tooth than the inner rotor. The outer rotor gear is contained within the close fitting cylindrical enclosure.

The inner rotor is typically secured to a drive shaft and, as it rotates on the drive shaft, it advances one tooth space per revolution relative to the outer rotor. The outer rotor is rotatably retained in a housing, eccentric to the inner rotor, and meshing with the inner rotor on one side. As the inner and outer rotors turn from their meshing point, the space between the teeth of the inner and outer rotors gradually increases in size through the first one hundred eighty degrees of rotation of the inner rotor creating an expanding space. During the last half of the revolution of the inner rotor, the space between the inner and outer rotors decreases in size as the teeth mesh.

When the device is operating as a pump, fluid to be pumped is drawn from an inlet port into the expanding space as a result of the vacuum created in the space as a result of its expansion. After reaching a point of maximum volume, the space between the inner and outer rotors begins to decrease in volume. After sufficient pressure is achieved due to the decreasing volume, the decreasing space is opened to an outlet port and the fluid forced from the device. The inlet and outlet ports are isolated from each other by the housing and the inner and outer rotors.

One significant problem with such devices are efficiency losses and part wear due to friction between the various moving parts of the configuration. Such loss of efficiency can be especially severe when the device is used as an engine or motor rather than a pump.

To eliminate frictional losses, various inventors such as Lusztig (U.S. Pat. No. 3,910,732), Kilmer (U.S. Pat. No. 3,905,727) and Specht (U.S. Pat. No. 4,492,539) have used rolling element bearings. However, such bearings have been used mainly to control frictional losses between the drive shaft and the device housing rather than the internal mechanism of the device itself.

Minto et al (U.S. Pat. No. 3,750,393) uses the device as an engine (prime mover) by providing high pressure vapor to the chambers which causes their expansion and associated rotation of the inner rotor shaft. On reaching maximum expansion of the chamber, an exhaust port carries away the expanded vapor. Minto recognizes that binding between the outer radial surface of the rotating outer gear and the close-fitting cylindrical enclosure due to differences in pressure between the inner and outer faces of the outer rotor element is a problem. To obviate the effect of the unbalanced radial hydraulic forces on the outer rotor, Minto proposes the use of radial passages in one of the end plates that extend radially outward from the inlet and outlet ports to the inner cylindrical surface of the cylindrical enclosure. These radial passages then communicate with a longitudinal groove formed in the inner surface of the cylindrical enclosure.

In order to improve efficiency through friction and wear reduction when the device is used as a pump, Dominique et al (U.S. Pat. No. 4,747,744) has made modifications to the device that reduce or minimize the frictional forces. However, Dominique also realizes that one of the problems with this type of device is by-pass leakage between the inlet and outlet ports of the device. That is, the operating fluid flows directly from the input to the output ports without entering the expanding and contracting chambers of the device. To reduce bypass leakage, Dominique forces the inner and outer rotors of the device into close contact with the end plate containing the inlet and outlet ports using a number of mechanisms including springs, pressurized fluids, magnetic fields, or spherical protrusions. Unfortunately this can lead to contact of the rotors with the end plate and attendance high frictional losses and loss of efficiency. Although such losses are not a major design factor when the device is used as a pump, it is of major concern when using the device as an engine and a motor. Here such frictional losses can be a major detriment to the efficiency of the engine.

In addition to frictional losses, the basic design of the device causes wear of the gear profiles, especially at the gear lobe crowns resulting in a degradation in chamber to chamber sealing ability. For good chamber to chamber sealing, a typical gear profile clearance is of the order of 0.002 inch (0.05 mm). To provide a hydrodynamic journal bearing between the outer radial surface of the outer rotor and the inner radial surface of the containment housing, a corresponding clearance of about 0.005-0.008 inch (0.13-0.20 mm) is needed. During running, small eccentricities of the outer rotor axis cause contact of the crowns of the inner and outer rotor lobes as they pass by each other resulting in wear of the gear lobe crowns and degradation of the chamber to chamber sealing ability.

Thus it is an object of this invention to provide a trochoidal gear device of high mechanical efficiency.

It is a further object of this invention to provide a trochoidal gear device with minimum friction losses.

It is an object of this invention to provide a trochoidal gear device with minimum mechanical friction losses.

It is a further object of this invention to provide a trochoidal gear device with minimum fluidic frictional losses.

It is another object of this invention to provide a mechanically simple energy conversion device.

It is an object of this invention to set precisely the gaps between moving surface of the device.

It is an object of this invention to provide a low-cost energy conversion device.

It is an object of this invention to provide a direct-coupled alternator/motor device in a hermetically sealed unit.

It is yet another object of this invention to provide a device that avoids degradation of its components.

It is a further object of this invention to provide a device with an integrated condensate pump for condensed fluid cycles such as Rankine cycles.

It is an object of this invention to provide a device for handling fluids that condense on expansion or contraction.

It is an object of this invention to provide a device that eliminates wear of rotor gear profiles.

Another object of this invention is to maintain high chamber to chamber sealing ability.

SUMMARY OF THE INVENTION

To meet these objects, the present invention is directed to a rotary, chambered, fluid energy-transfer device of the class referred to as trochoidal gear pumps and engines of which the gerotor is a species. The device is contained in a housing having a cylindrical portion with a large bore formed therein. A circular end plate is attached to the cylindrical portion and has a fluid inlet passage and a fluid outlet passage. An outer rotor rotates within the large bore of the cylindrical housing portion. The outer rotor has a bore formed in it leaving a radial portion with an outer radial edge facing the interior radial surface of the bore in the housing cylinder. A female gear profile is formed in the interior bore of the outer rotor. An end covers the bore and female gear profile of the outer rotor. A second end face opposite the covering end skirts the female gear profile. An inner rotor is contained within the interior bore of the outer rotor and has a male gear profile that is in operative engagement with the female gear profile of the outer rotor. The male gear profile of the inner rotor has one less tooth than the outer gear profile and an axis that is eccentric with the axis of the outer rotor gear profile.

The present invention features a coaxial hub that extends normally form the end that covers the outer rotor or from a face of the inner rotor. The hub portion may be formed as an integral part of the inner or outer rotor or as a separate shaft typically in force fit engagement with the inner or outer rotor. In one of the preferred embodiments, a coaxial hub extends from both the end plate of the outer rotor and a face of the inner rotor. The hub on either rotor has a shaft portion that is mounted in the housing with a rolling element bearing assembly. The rolling element bearing assembly has at least one rolling element bearing with the assembly being used to set the rotational axis or the axial position of the rotor with which it is associated. Preferably both the rotational axis and the axial position of the rotor are set with the bearing assembly. Various types of rolling element bearings can be used with the bearing assembly including thrust bearings, radial load ball bearings, and tapered rolling element bearings. Preferably a pair of pre-loaded, rolling element bearings, e.g., angular-contact or deep groove ball bearings, are used to set both the rotational axis and the axial position of the associated rotor.

The feature of precisely setting the rotational axis or axial position of a particular rotor with a bearing assembly has the advantage of maintaining a fixed-gap clearance of the associated rotor with at least one surface of the housing or the other rotor. Depending on its location, the fixed-gap clearance between the rotor surface and housing surface or the other rotor surface is set at a distance that is 1) greater than the boundary layer of the operating fluid used in the device in order to minimize operating fluid shear forces or 2) at a distance that is optimal for a) minimizing by-pass leakage i) between chambers formed by the engagement of the female and male gear profiles, ii) between these chambers and the inlet and outlet passages, and iii) between the inlet and outlet passages and also b) for minimizing operating fluid shear forces. In one preferred embodiment, both rotors have hubs that are mounted with bearing assemblies in the housing in order to control all interface surfaces between each rotor and its opposing housing surface or between the interface surfaces of two opposing rotor surfaces. This has the advantage of keeping frictional loses in the device to a minimum and allowing the device to function as a very efficient expansion engine or fluid compressor.

In a configuration that features a rolling element bearing assembly to fix the axial position or rotational axis or both of the outer rotor, the inner rotor has a bored central portion that allows for rotation about a hub that extends from the end plate. Fixing of the rotational axis of the outer rotor with a bearing assembly has the advantage of eliminating the need to provide pressure equalizing grooves between the chambers to prevent unbalanced radial hydraulic forces that result in contact of the outer radial surface of the outer rotor with the cylindrical housing and attendant frictional loss and even seizing of the rotor and housing. Another feature of this embodiment is the use of a rolling element bearing positioned between the end plate hub and the inner surface of the central bore portion of the inner rotor which has the advantage of reducing substantially the frictional losses from the rotation of the inner rotor about the end plate hub. This configuration also features the use of a bearing assembly, e.g., a thrust bearing such as a needle thrust bearing, to maintain a minimum fixed-gap clearance between the inner face of the end plate and the end face of the inner rotor. This has the further advantage of eliminating contact between the inner rotor end face and the end plate and setting the minimum fixed-gap clearance that is maintained between the two surfaces. At operating pressures, hydraulic forces urge the inner rotor to the minimum fixed-gap clearance position thereby also maintaining a fixed-gap clearance between the opposite face of the inner rotor and the inner face of the closed end of the outer rotor.

The present invention maintains superior chamber to chamber sealing ability over long periods of use. In prior art devices, gear lobe crown wear occurs as a result of the need to use a small gear profile clearance between the inner and outer rotor gear profiles, e.g., 0.0002 inch, in order to maintain chamber to chamber sealing ability while the required clearance between the outer rotor and housing needs to be several times larger, e.g., 0.005-0.008 inch, in order to form a hydrodynamic journal bearing. During running, small eccentricities of the outer rotor axis cause contact of the lobe crowns of the inner and outer rotors resulting in lobe wear and degradation of the chamber to chamber sealing ability. The feature of using rolling element bearings to set and maintain the axes of both rotors to within a few ten-thousandths of an inch and even less when pre-loaded are used has the advantage of eliminating shear on the lobe crowns and maintaining superior chamber to chamber sealing ability over the life of the device.

The present invention is especially useful in handling two-phase fluids in expansion engines and contracting fluid devices (compressors). When operating as an engine, the device features and output shaft that has the advantage of accommodating an integrated condensate pump with the further advantages of eliminating pump shaft seals and attendant seal fluid losses and matching pump and engine capacity in Rankine cycles where the fluid mass flow rate is the same through both the engine and condensate pump.

The invention also features a vent conduit from the housing cavity to a lower pressure input or output port which has the advantage of controlling built-up fluid pressure in the internal housing cavity thereby reducing fluid shear forces and also of alleviating strain on the housing structure especially when used as a hermetically sealed unit with magnetic drive coupling. The invention also features a pressure regulating valve, such as a throttle valve (automatic or manual), to control operating fluid pressure in the housing cavity. By controlling and maintaining a positive pressure in the housing cavity, bypass leakage at the interface between the outer rotor and the end plate and excessive pressure build up with attendant large fluid shear force energy losses and housing structural strain are substantially reduced.

In one aspect, the invention relates to a rotary chambered fluid energy-transfer device. The device includes a housing with a central portion with a bore and an end plate with an inlet passage and an outlet passage. The device also includes an outer rotor that can rotate in the central portion bore. The outer rotor includes a female gear profile formed in a radial portion, a first end covering the female gear profile, a second end skirting the female gear profile, and a hub extending from the first end and mounted in the housing with a first bearing assembly including a rolling element bearing. The device further includes an inner rotor with a male gear profile in operative engagement with the outer rotor. The inner rotor also has a bore and is mounted in the housing with a second bearing assembly including a first rolling element bearing and a second rolling element bearing mounted in a pre-loaded configuration with each other. The first bearing assembly and the second bearing assembly set at least one of a rotational axis of the inner rotor, a rotational axis of the outer rotor, an axial position of the inner rotor, and an axial position of the outer rotor. The first bearing assembly and the second bearing assembly also maintain a fixed-gap clearance of at least one of the inner rotor and the outer rotor with at least one surface of the housing and the other rotor.

In an embodiment of the foregoing aspect, the fluid energy-transfer device is adapted for use as a prime mover. In another embodiment, the fixed-gap clearance may be a distance greater than a fluid boundary layer of an operating fluid used in the device. The fixed-gap clearance may also be a substantially optimal distance as a function of bypass leakage and operating fluid shear forces.

In yet another embodiment, a pressurized operating fluid may be used in the fluid energy-transfer device to provide a motive force. In further embodiments, the inlet passage and the outlet passage of the end plate may be configured for optimum expansion of the pressurized fluid in the rotary chambered fluid energy-transfer device. The pressurized fluid may be in both a gaseous state and a liquid state or just a gaseous state. In one embodiment, the fluid energy-transfer device includes an integrated condensate pump driven from an output shaft of the device.

In various other embodiments, the fluid energy-transfer device may be hermetically sealed or magnetically coupled with an external rotational shaft. In another embodiment the fluid energy-transfer device includes a conduit for venting operating fluid from an internal housing cavity. In further embodiments, the operating fluid may be vented to the outlet passage and the conduit may include a pressure regulating valve. In yet other embodiments, the fluid energy-transfer device may be adapted for use as a compressor. In a further embodiment, the inlet passage and the outlet passage of the end plate may be configured for optimum compression of the fluid.

In other embodiments, the second bearing assembly may be mounted on a hub of the housing. In further embodiments, the housing hub may be integral with the end plate. An end cap may be attached to the housing hub to preload the second bearing assembly. In other embodiments the housing hub may be attached to the end plate and may include an end flange to preload the second bearing assembly. In another embodiment, the first bearing assembly further includes a second rolling element bearing mounted in a pre-loaded configuration.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

BRIEF DESCRIPTION OF THE DRAWINGS

Other features and advantages of the present invention, as well as the invention itself, can be more fully understood from the following description of the various embodiments, when read together with the accompanying drawings.

Figure 1:
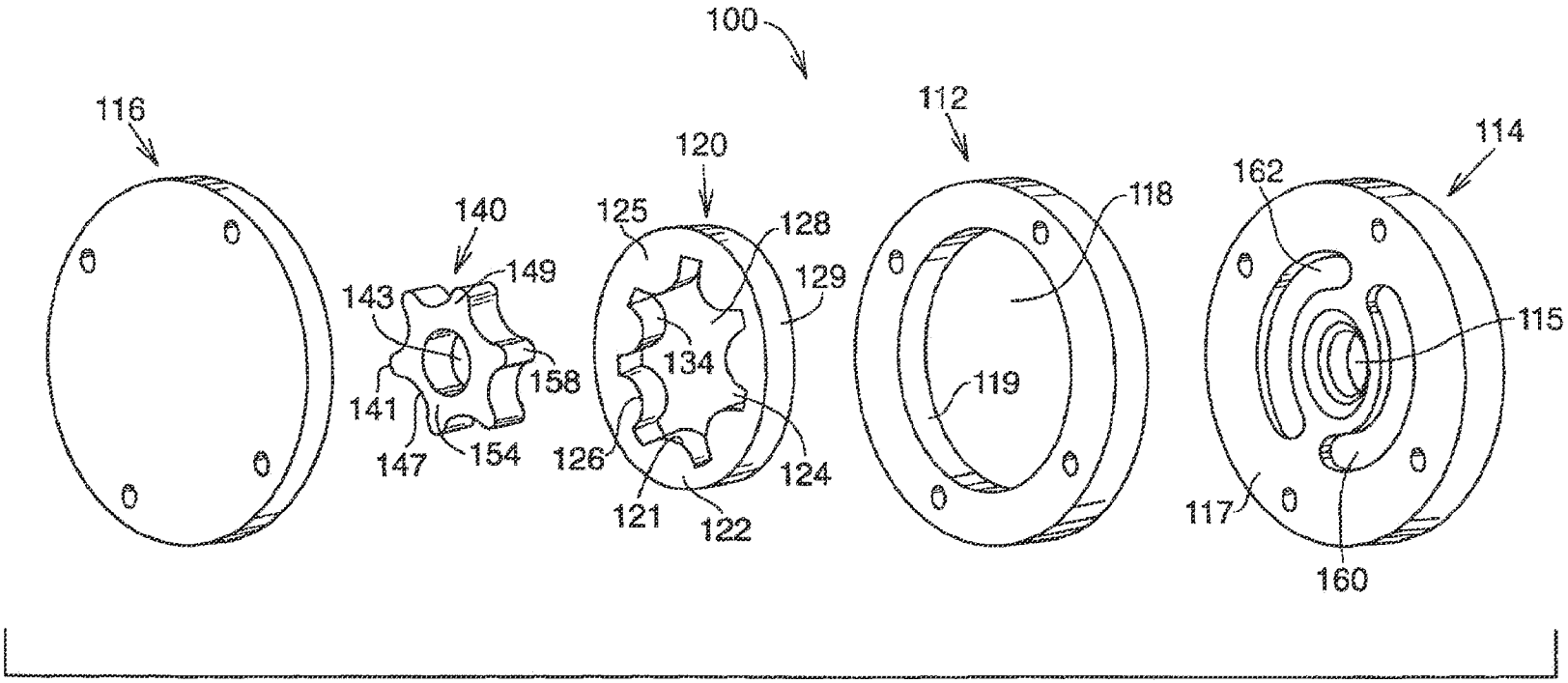
PRIOR ART Fig. 1
FIG. 1 is an exploded perspective view of a conventional trochoidal gear device.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

Figure 3:
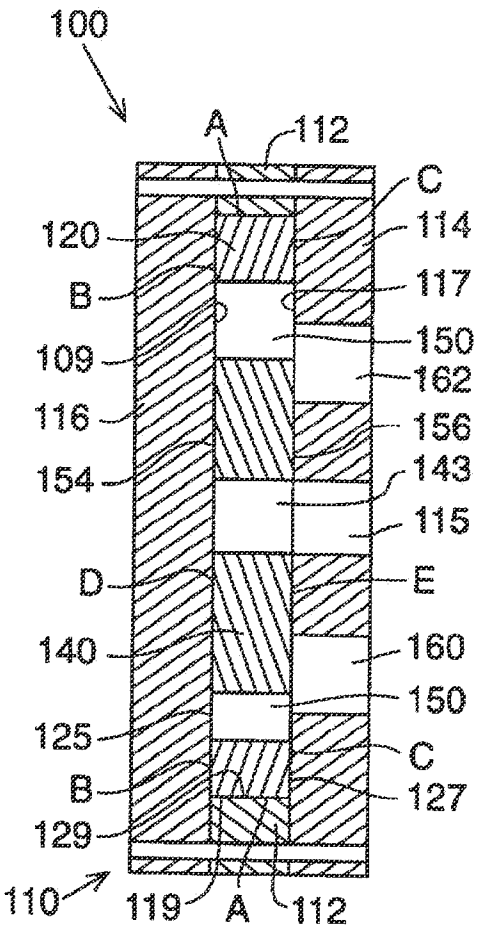
PRIOR ART Fig. 3
FIG. 3 is a cross-sectional view of a conventional trochoidal gear device taken along a diameter of the cylindrical housing.
Figure 2:
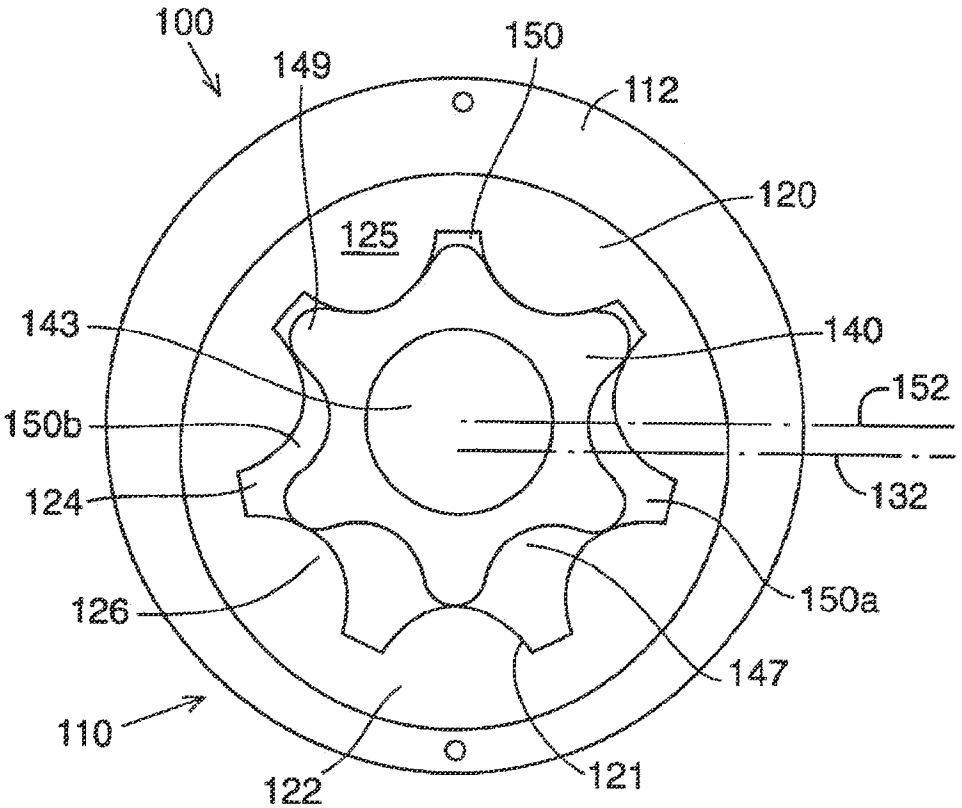
PRIOR ART Fig. 2
FIG. 2 is a sectional end view of a conventional trochoidal gear device with an end plate removed.

With reference to the drawings and initially FIGS. 1-3, a conventional trochoidal element, fluid displacement device (pump or engine) of which a species is a gerotor is generally denoted as device 100 and includes a housing 110 with a cylindrical portion 112 having a large axial cylindrical bore 118 typically closed at opposite ends in any suitable manner, such as by removable static end plates 114 and 116 to form a housing cavity substantially identical with cylindrical housing bore 118.

An outer rotor 120 freely and rotatably mates with the housing cavity (axial bore 118). That is, the outer peripheral surface 129 and opposite end faces (surfaces) 125 and 127 of outer rotor 120 are in substantially fluid-tight engagement with the inner end faces (surfaces) 109, 117 and peripheral radial inner surface 119 which define the housing cavity. The outer rotor element 120 is of known construction and includes a radial portion 122 with an axial bore 128 provided with a female gear profile 121 with regularly and circumferentially spaced longitudinal grooves 124, illustrated as seven in number, it being understood that his number may be varied, the grooves 124 being separated by longitudinal ridges 126 of curved transverse cross section.

Registering with the female gear profile 121 of outer rotor 120 is an inner rotor 140 with male gear profile 141 rotatable about rotational axis 152 parallel and eccentric to rotational axis 132 of outer rotor 120 and in operative engagement with outer rotor 120. Inner rotor 140 has end faces 154,156 in fluid-tight sliding engagement with the end faces 109,117 of end plates 116,114 of housing 110 and is provided with an axial shaft (not shown) in bore 143 projecting through bore 115 of housing end plate 114. Inner rotor 140, like outer rotor 120, is of known construction and includes a plurality of longitudinally extending ridges or lobes 149 of curved transverse cross section separated by curved longitudinal valleys 147, the number of lobes 149 being one less than the number of outer rotor grooves 124. The confronting peripheral edges 158,134 of the inner and outer rotors 140 and 120 are so shaped that each of the lobes 149 of inner rotor 140 is in fluid-tight linear longitudinal slidable or rolling engagement with the confronting inner peripheral edge 134 of the outer rotor 120 during full rotation of inner rotor 140.

A plurality of successive advancing chambers 150 are delineated by the housing end plates 114,116 and the confronting edges 158,134 of the inner and outer rotors 140, 120 and separated by successive lobes 149. When a chamber 150 is in its topmost position as viewed in FIG. 2, it is in its fully contracted position and, as it advances either clockwise or counterclockwise, it expands until it reaches and 180.degree. opposite and fully expanded position after which it contracts with further advance to its initial contracted position. It is noted that the inner rotor 140 advances one lobe relative to the outer rotor 120 during each revolution by reason of there being one fewer lobes 149 than grooves 124.

Port 160 is formed in end plate 114 and communicates with expanding chambers 150*a*. Also formed in end plate 114 is port 162 reached by forwardly advancing chambers 150 after reaching their fully expanded condition, i.e., contracting chambers 150*b*. It is to be understood that chambers 150*a* and 150*b* may be expanding or contracting relative to ports 160, 162 depending on the clockwise or counterclockwise direction of rotation of the rotors 120,140.

When operating as a pump or compressor, a motive force is applied to the inner rotor 140 by means of a suitable drive shaft mounted in bore 143. Fluid is drawn into the device through a port, e.g., 160 by the vacuum created in expanding chambers 150*a* and after reaching maximum expansion, contracting chambers 150*b* produce pressure on the fluid which is forced out under pressure from the contracting chambers 150*b* into the appropriate port 162.

When operating as an engine, a pressurized fluid is admitted through a port, e.g., 160, which causes an associated shaft to rotate as the expanding fluid causes chamber 150 to expand to its maximum size after which the fluid is exhausted through the opposite port as chamber 150 contracts.

In the past, it has been customary to mount rotors 120 and 140 in close clearance with the housing 110. Thus the outer radial edge 129 of outer rotor 120 is in close clearance with the interior radial surface 119 of cylindrical housing portion 112 while the ends (faces) 125,127 of outer rotor 120 are in close clearance with the inner faces 117,109 of end plates 114 and 116. The radial close tolerance interface between the radial edge 129 of outer rotor 120 and inner radial housing surface 119 is designated as interface A while the close tolerance interfaces between the ends 125, 127 of outer rotor 120 and faces 109, 117 of end plates 114 and 116 are designated as interfaces B and C. Similarly the close tolerance interfaces between the faces 154, 156 of inner rotor 140 and faces 109, 117 of end plates 114, 116 are designated as interfaces D and E. The close radial tolerance of interface A necessary to define the rotational axis of rotor 120 and the close end tolerances of interfaces B, C, D, and E required for fluid sealing in chambers 150 induce large fluid shear losses that are proportional to the speed of the rotors 120 and 140. In addition, unbalanced hydraulic forces on the faces 125, 127, 154, 156 of the rotors 120 and 140 can result in intimate contact of the rotor faces 125, 127, 154, 156 and the inner faces 109, 117 of the static end plates 114,116 causing very large frictional losses and even seizure. Although shear losses can be tolerated when the device is operated as a pump, such losses can mean the difference between success and failure when the device is used as an engine.

Figure 4:
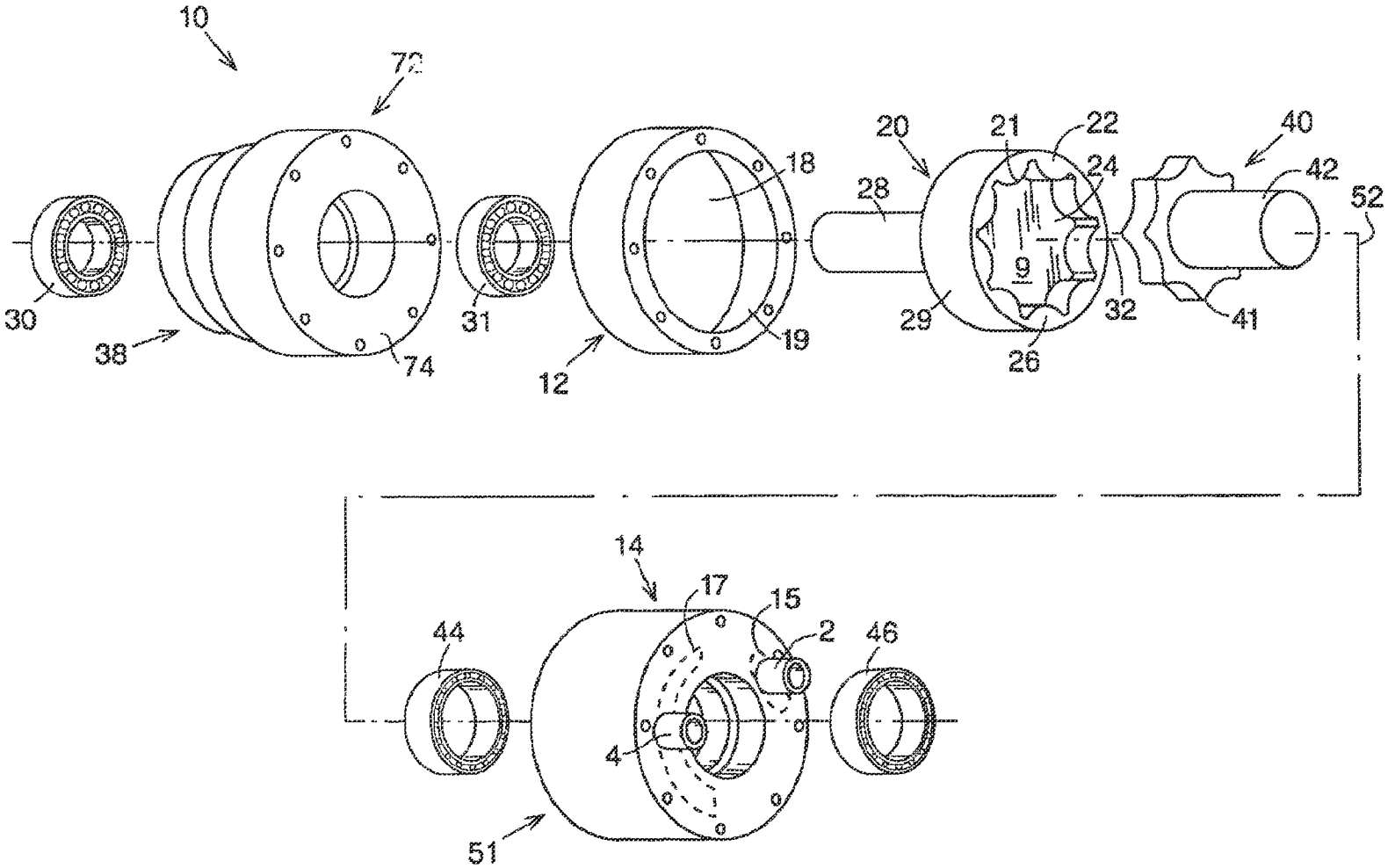
FIG. 4 is an exploded perspective view of the present invention illustrating the use of pre-loaded bearing assemblies with hubs on both the inner and outer rotors.

To overcome the large fluid shear and contact losses, the rotors have been modified to minimize these large fluid shear and contact losses. To this end, the rotary, chambered, fluid energy-transfer device of the present invention is shown in FIGS. 4-7 and designated generally as 10. Device 10 comprises a housing 11 having a central, typically cylindrical, portion 12 with a large cylindrical bore 18 formed therein and a static end plate 14 having inlet and outlet passages designated as a first passage 15 and a second passage 17 (FIGS. 4 and 7), it being understood that the shape, size, location and function of the first passage 15 and second passage 17 will vary depending on the application for which the device is used. Thus when the device is used to pump liquids, the inlet and outlet (exhaust) ports encompass nearly 180.degree. each of the expanding and contracting chamber arcs in order to prevent hydraulic lock or cavitation (FIG. 1, ports 160 and 162). However, when the device is used as an expansion engine or compressor, inlet and exhaust ports that are too close to each other can be the source of excessive bypass leakage loss. For compressible fluids such as employed when the device is used as an expansion or contraction machine (FIG. 7, ports 15 and 17), the separation between the inlet and exhaust ports 15 and 17 is much greater, thereby reducing leakage between the ports, the leakage being inversely proportional to the distance between the high and low pressure ports 15 and 17. For compressible fluids, the truncation of one of the ports, e.g., port 15, causes fluid to be trapped in the chambers 50 formed by the outer rotor 20 and inner rotor 40 with no communication to the ports 15 or 17 resulting in expansion or contraction of the fluid (depending on the direction of rotation of the rotors) promoting rotation of the rotors when the device is used as an expansion machine or work being applied to the rotors when the device is used as a compression machine. In addition, the length of the truncated port 15 determines the expansion or compression ratio of the device, that is, the expansion or compression ratio of device 10 can be changed by altering the circumferential length of the appropriate port. For an expansion engine, port 15 is the truncated inlet port with port 17 serving as the exhaust or outlet port. For a contraction device, the roles of ports 15 and 17 are reversed, that is, port 15 serves as the exhaust port while port 17 serves as the inlet port. When operating as a contracting or compression machine, the direction of rotation of rotors 20 and 40 is opposite to that shown in FIG. 7. Parts 15 and 17 communicate with conduits 2 and 4 (FIG. 4).

Figure 5A:
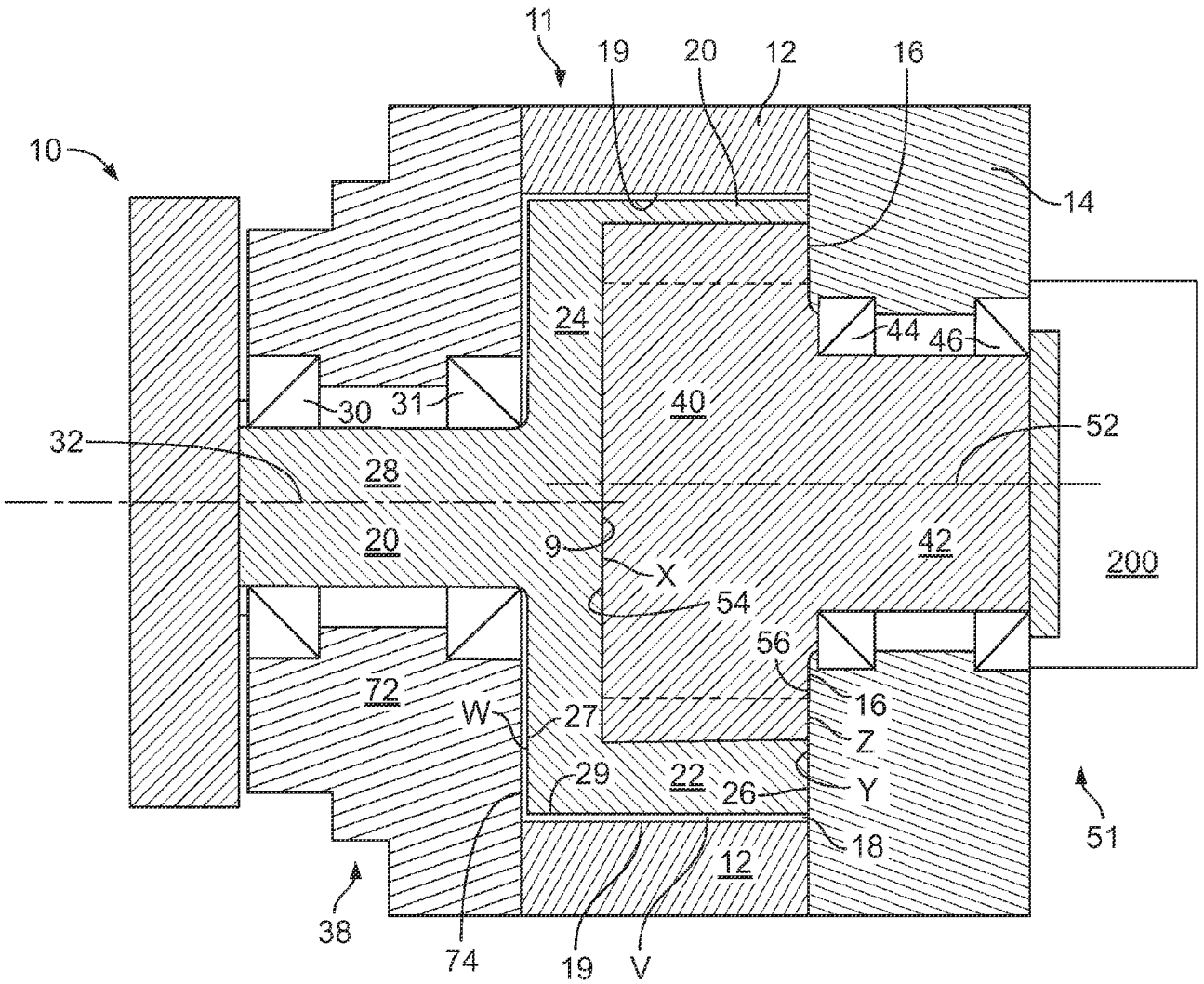
FIG. 5A is a cross sectional view of the present invention illustrating the use of pre-loaded bearing assemblies with hubs on both the inner and outer rotors with a schematic illustration of an integrated condensate pump assembly using the shaft of the inner rotor as a pump shaft.

To eliminate the fluid shear and other frictional energy losses at the interface between the outer rotor and one of the end plates (interface B between rotor 120 and end plate 116 in FIG. 3), the end plate and outer rotor can be formed as one piece or otherwise suitably attached as shown in FIGS. 4 and 5A. That is, the outer rotor 20 comprises (1) a radial portion 22, (2) a female gear profile 21 formed in radial portion 22, (3) and end 24 that covers female gear profile 21 and rotates as part of rotor 20 and which may be formed as an integral part of the radial portion 22, and (4) a rotor end surface or end face 26 that skirts female gear profile 21.

An inner rotor 40, with a male gear profile 41, is positioned in operative engagement with outer rotor 20. Outer rotor 20 rotates about rotational axis 32 which is parallel and eccentric to rotational axis 52 of inner rotor 40.

By attaching end plate 24 to rotor 20 and making it a part thereof, it rotates with radial portion 22 containing female gear profile 21 and thereby completely eliminates the fluid shear losses that occur when rotor 20 rotates against a static end plate (interface B in FIG. 3). Further, since end face 54 of inner rotor 40 rotates against the rotating interior face 9 of end 24 of rotor 20 rather than against a static surface, the fluid shear losses at resulting interface X (FIGS. 5A and 6) are significantly reduced. Specifically, since the relative rotational speed between the inner rotor 40 and outer rotor 20 is 1/N times the outer rotor 20 speed, where N is the number of teeth on the outer rotor 20, the sliding velocity between the end face 54 of the inner rotor 40 and the rotating interior face 9 of end closure 24 on outer rotor 20 is proportionally reduced as compared to the usual mounting configuration shown in FIGS. 1-3. Hence for the same fluid and clearance conditions, the losses are 1/N as large. Additionally, because the rotating end closure plate 24 is attached to the outer rotor, bypass leakage from chambers 50 past the interface between the static end plate (interface B in FIG. 3) to the radial extremities of the device, e.g., the gap at interface V, is completely eliminated.

In addition to interface X, the interface between the rotating interior face 9 of end 24 of outer rotor 20 and the face 54 of inner rotor 40, five additional interfaces are the focus of the current invention. These include, 1) interface V between the interior radial surface 19 of cylindrical housing portion 12 and the outer radial edge 29 of outer rotor 20, 2) interface W between end face 74 of housing element 72 and exterior face 27 of end 24 of rotor 20, 3) interface Y between end face 26 of rotor 20 and interior end face 16 of end plate 14, and 4) interface Z between face 56 of inner rotor 40 and interior end face 16 of end plate 14. Of lesser concern is interface U, the interface between the interior face 9 of end 24 of outer rotor 20 and face 8 of hub 7 of end plate 14. Because of the relatively low rotation velocities in the area of interior face 9 near its rotational axis 32, any clearance that prevents contact of the two surfaces is usually acceptable.

By maintaining a fixed-gap clearance between at least one of the surfaces of one of the rotors and the housing 11 or the other rotor, fluid shear and other frictional forces can be reduced significantly lading to a highly efficient device especially useful as an engine or prime mover. To maintain such a fixed-gap clearance, either the outer rotor 20 or the inner rotor 40 or both are formed with a coaxial hub (hub 28 on rotor 20 or hub 42 on rotor 40) with at least a portion of hub 28 or 42 is formed as a shaft for a rolling element bearing and mounted in housing 11 with a rolling element bearing assembly (38 or 51 or both) with the rolling element bearing assembly comprising a rolling element bearing such as ball bearings 30, 31, 44 or 46. The rolling element bearing assembly 38 or 51 or both sets establish: 1) the rotational axis 32 of outer rotor 20 or the rotational axis 52 of inner rotor 40, or 2) the axial position of outer rotor 20 or the axial position of the inner rotor 40, or 3) both the rotational axis and axial position of outer rotor 20 or inner rotor 40, or 4) both the rotational axis and axial position of both other rotor 20 and inner rotor 40. It is to be realized that the bearing assembly 38 or 51 includes elements that attach to or are a part of device housing 11. Thus in FIG. 5A, bearing assembly 38 includes static bearing housing 72 which is also a part of housing 11. Similarly bearing assembly 51 includes static bearing housing 14 which also serves as the static end plate 14 of housing 11.

Referring to FIG. 5A, it is seen that by setting the rotational axis of outer rotor 20 with hub 28 and bearing assembly 38, a fixed-gap clearance is maintained at interface V, the interface between radial inner surface 19 of cylindrical housing portion 12 and outer radial edge 29 or outer rotor 20. By setting the axial position of outer rotor 20 with bearing assembly 38, a fixed-gap clearance is maintained at interface W, the interface between face 74 of housing element 72 and exterior face 27 of end 24 of outer rotor 20 and interface Y, the interface between face 26 and rotor 20 and face 16 of static end plate 14. By setting the axial position of inner rotor 40 with hub 42 and bearing assembly 51, a fixed-gap clearance is maintained at interface Z, the interface between face 56 of inner rotor 40 and face 16 of end plate 14.

To set a fixed-gap clearance at interface X, both the axial position of outer rotor 20 and the axial position of inner rotor 40 must be fixed. As shown in FIG. 5A, hub 28 and bearing assembly 38 are used to set the axial position of outer rotor 20 which in turn sets the axial position of the interior face 9 of end 24. Hub 42 and bearing assembly 51 set the axial position of inner rotor 40 which also sets the axial position of face 54. By setting the axial position of face 54 (rotor 40) and face 9 (rotor 20), a fixed-gap clearance at interface X is defined.

The fixed-gap clearances at interface V and W are set to reduce fluid shear forces as much as possible. Since frictional forces due to the viscosity of the fluid are restricted to the fluid boundary layer, it is preferable to maintain the fixe gap distance at as great a value as possible to avoid such forces. Preferably for the purposes of this invention, the boundary layer is taken as the distance from the surface where the velocity of the flow reaches 99 percent of a free stream velocity. As such, the fixed gap clearance at interface V and W depend on and is determined by the viscosity of the fluid used in the device and the velocity at which the rotor surfaces travel with respect to the surfaces of the static components. Given the viscosity and velocity parameters, the fixed gap clearances at interface V and W are preferably set at a value greater than the fluid boundary layer of the operating fluid used in the device.

For the fixed-gap clearances at interfaces X, Y and Z, consideration must be given to reducing both fluid shear forces and bypass leakage between 1) the expanding and contracting chambers 50 and the device, 2) the inlet and outlet passages 15 and 17 and 3) the expanding and contracting chambers 50 and the inlet and outlet passages 15 and 17. Since bypass leakage is proportional to clearance to the third power and shearing forces are inversely proportional to clearance, the fixed gap of these interfaces is set to a substantially optimal distance as a function of both bypass leakage and operating fluid shear losses, that is, sufficiently large to substantially reduce fluid shear losses but small enough to avoid significant bypass leakage. One may obtain the optimal operating clearance distance from a simultaneous solution of equations for the bypass leakage and fluid shearing force to yield an optimum clearance for a given set of operating conditions. For gases and liquid vapors, the bypass leakage losses dominate, especially at higher pressures, hence the clearances are optimally set at the minimum practical mechanical clearance, e.g., roughly about 0.001 inches (0.025 mm) for a device with an outer rotor diameter of about 4 inches (0.1 m). For liquids, the simultaneous solution of the leakage and shear equations typically provide the optimal clearance. Mixed-phase fluids are not readily amenable to mathematical solution due to the gross physical property differences of the individual phases and thus are best determined empirically.

Figure 6:
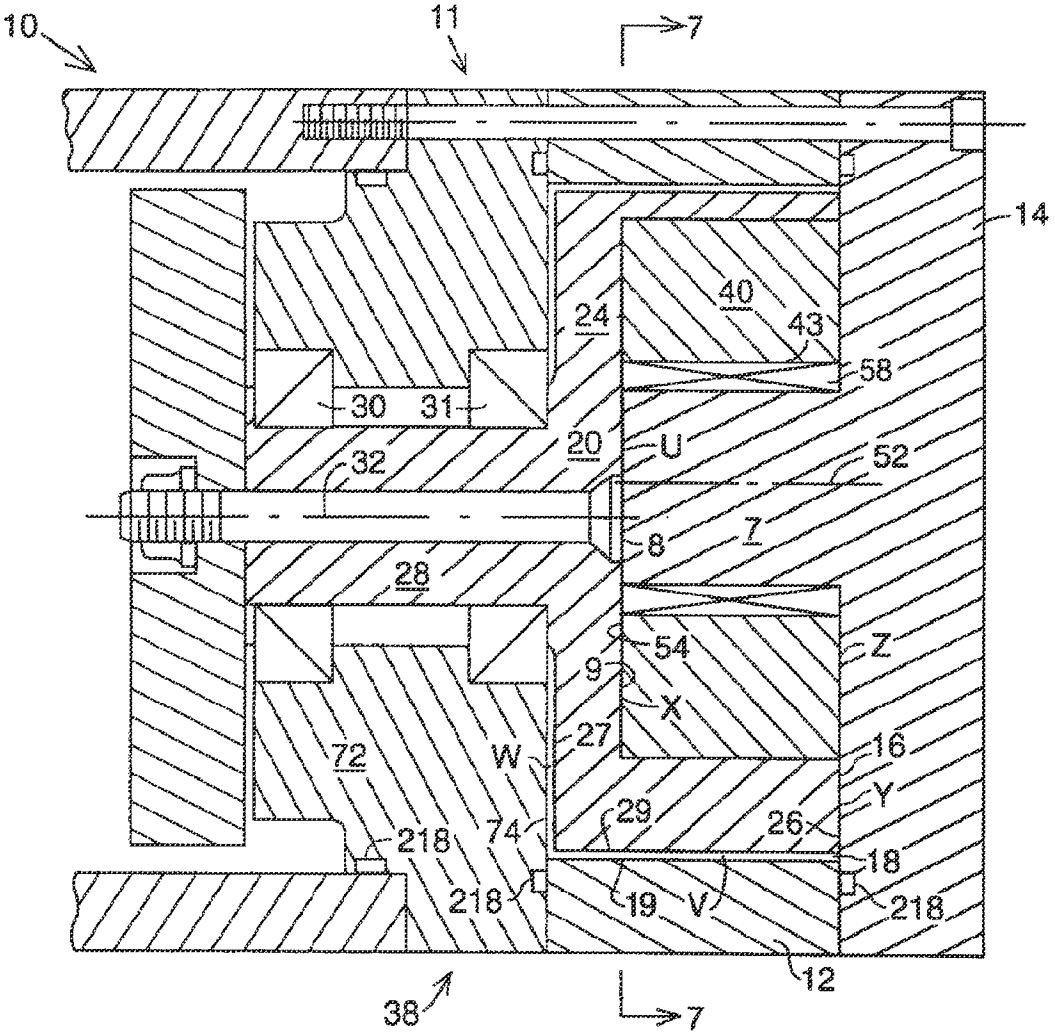
FIG. 6 is a cross-sectional view of the present invention illustrating the use of a pre-loaded bearing assembly with the hub on the outer rotor while the inner rotor is allowed to float on a hub and roller bearing assembly projecting from the housing end plate.
Figure 7:
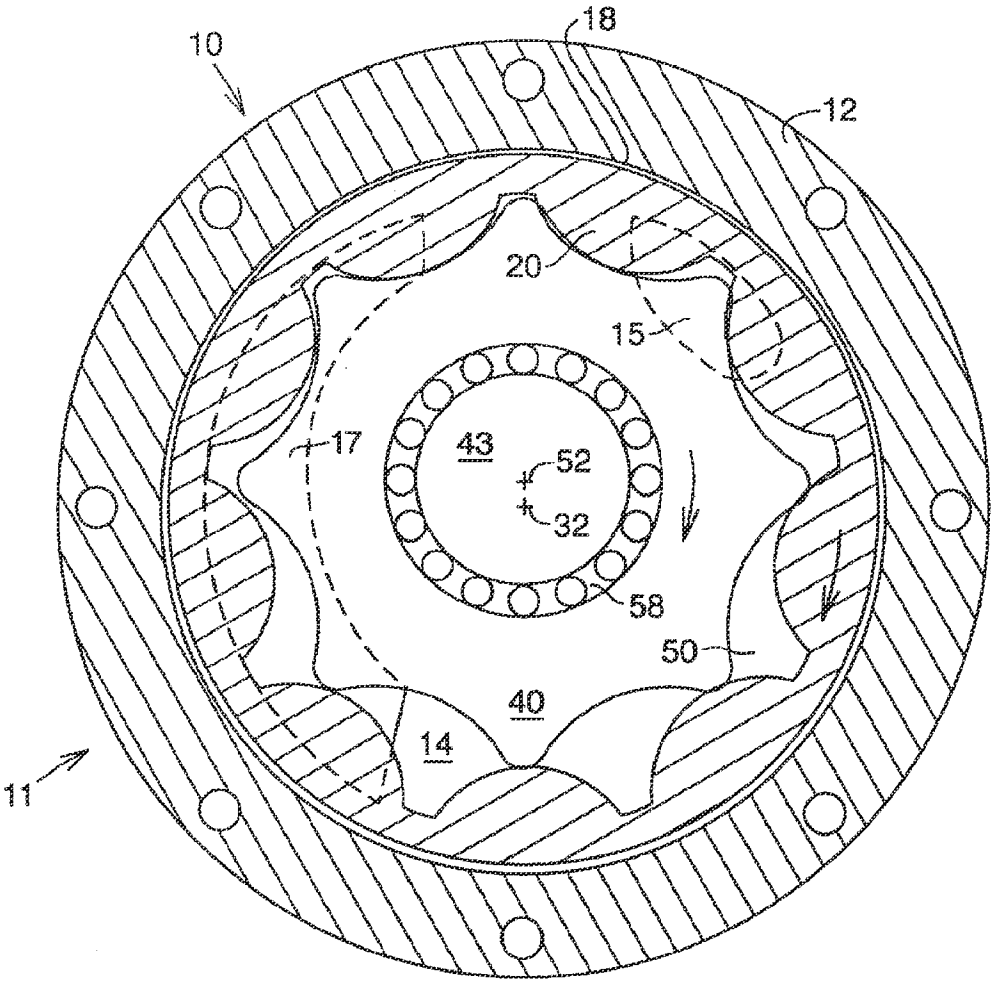
FIG. 7 is a cross-sectional end view of the present invention illustrating the inner and outer rotors along with the inlet and outlet porting configurations.

Referring to FIG. 6, outer rotor 20 has a coaxial hub 28 extending normally and outwardly from end 24 with a shaft portion of hub 28 mounted in static housing 11 by means of bearing assembly 38 which comprises static bearing housing 72 and at least one rolling element bearing. As shown, preloaded ball bearings 30 and 31 are used as part of bearing assembly 38 to set both the axial position and rotational axis (radial position) of outer rotor 20. The rotational axis 52 of inner rotor 40 is set by hub 7 which extends normally into bore 18 of cylindrical housing portion 12 from end plate 14. Inner rotor 40 is formed with an axial bore 43 by which inner rotor 40 is axially located for rotation about hub 7. A rolling element bearing such as roller bearing 58 is located between the shaft portion of hub 7 and inner rotor 40 and serves to reduce friction between the inner surface of bore 43 and the shaft of hub 7.

The fixed-gap clearance of interface U, the interface between the interior face 9 of end 24 and face 8 hub 7, is maintained with bearing assembly 38. Because of the lower velocities and associated lower shear forces in this region relative to those found at the outer radial extremities of the interior surface 9 of end plate 24, it is generally sufficient to maintain the fixed clearance gap so as to avoid direct contact of the two surfaces.

The bearing assembly 38 is used to maintain the rotational axis 32 of outer rotor 20 in eccentric relation with the rotational axis 52 of the inner rotor 40 and also to maintain a fixed-gap clearance between the radial outer surface (29) of outer rotor (20) and the interior radial surface (19) of housing section 12, i.e., interface V, preferably at a distance greater than the fluid boundary layer of the operating fluid in the drive.

Bearing assembly 38 is also used to maintain the axial position of outer rotor 20. When used to maintain axial position, bearing assembly 38 functions to maintain a fixed-gap clearance 1) at interface W, the interface between face 74 of bearing and device housing 72 and the exterior face 27 of end 24 of outer rotor 20 and 2) at interface Y, the interface between end face 26 of said outer rotor 20 with the interior face 16 of housing end plate 14. The fixed-gap clearance at interface W is typically set at a distance greater than the fluid boundary layer of the operating fluid in device 10 while the fixed-gap clearance of interface Y is set at a distance that minimized both bypass leakage and operating fluid shear forces taking into consideration that bypass leakage is a function of clearance to the third power while fluid shearing forces are inversely proportional to clearance.

Having set the fixed-gap clearance of interface Y to minimize both bypass leakage and operating fluid shear forces, the fixed-gap clearance of interfaces X and Z are not set. Since interfaces X and Z are in the region of the rotational axes of the inner and outer rotor and the inner rotor rotates relatively slower with respect to the rotating end plate of outer rotor 20 than with respect to the end plate 24, as a first approximation combined interfaces X and Z can be set equal to the total fixed-gap clearance of interface Y, that is X+Z=Y. This is conveniently accomplished by match grinding the inner and out rotor end faces to afford inner and outer rotors with identical axial lengths. The inner rotor can be ground slightly shorter or slightly longer than the outer rotor; however, when using an inner rotor with an axial length slightly longer than the outer rotor care must be taken to assure that the length of the inner rotor is less than the length of the outer rotor plus the clearance of interface Y.

Various types of rolling element bearings may be used as a part of bearing assembly 38. To control and fix the radial axis of rotor 20, a bearing with a high radial load capacity, that is, a bearing designated principally to carry a load in a direction perpendicular to the axis 32 of rotor 20 is used. To control and fix the axial position of rotor 20, a thrust bearing, that is, a bearing with a high load capacity parallel to the axis of rotation 32, is used. To control and fix both the radial and axial position of rotor 20 with respect to both radial and thrust (axial) loads, various combinations of ball, roller, thrust, tapered, or spherical bearings may be used.

Figure 8:
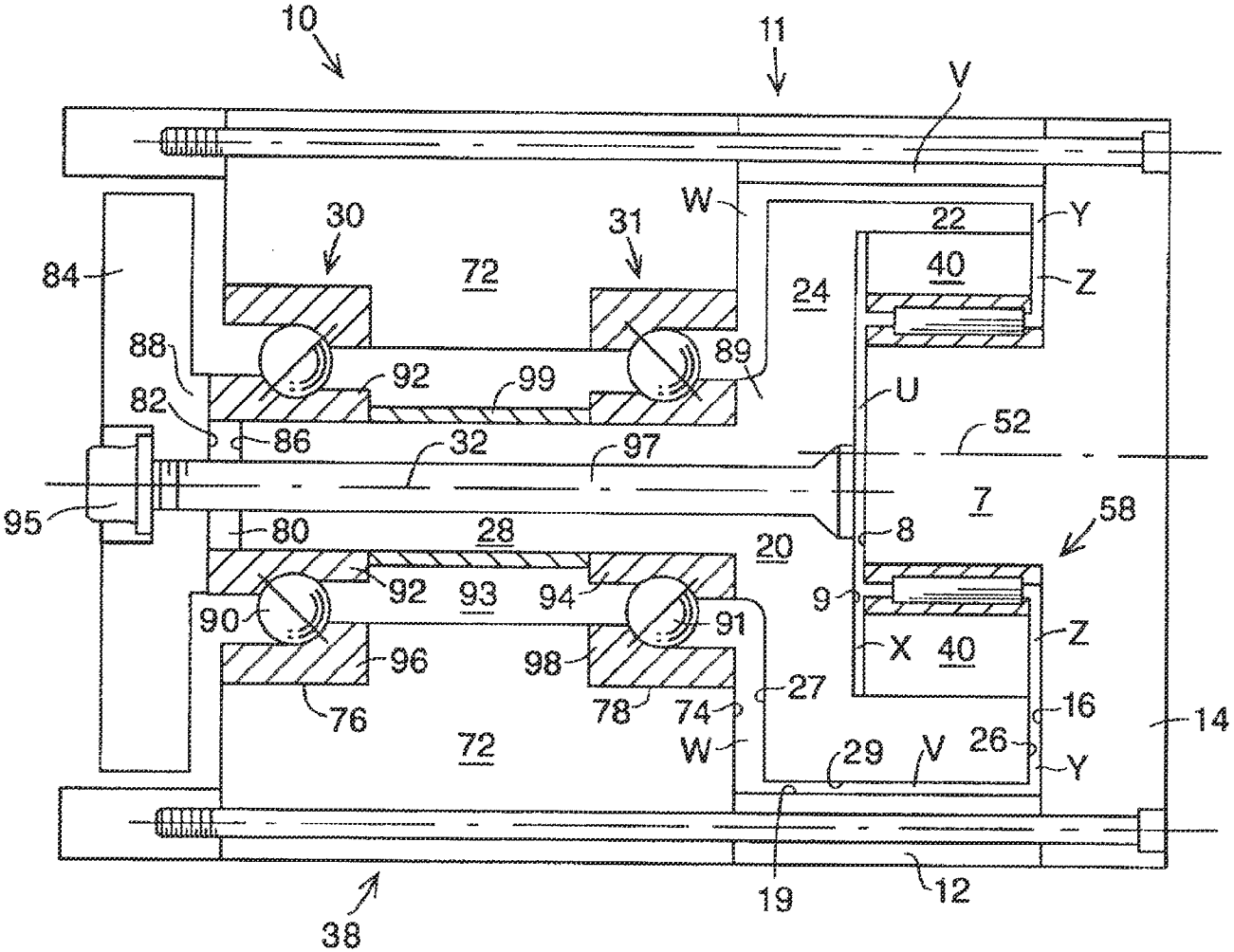
FIG. 8 is a cross-sectional view of the present invention illustrating a pre-loaded bearing assembly associated with the outer rotor and a floating inner rotor. Cross-sectional hatching for some parts has been eliminated for clarity and illustrative purposes.

Of particular significance here is the use of a pair of preloaded bearings. Such a bearing configuration exactly defines the rotational axis of rotor 20 and precisely fixes its axial position. For example and as shown in FIG. 8, bearing assembly 38 has a bearing housing 72 that is a part of device housing 11 and contains a pair of pre-loaded, angular contact ball bearings 30 and 31 mounted on shoulders 76 and 78 of bearing housing 72. Gap 80, defined by face 82 of flange 84, bearing race 92 and end face 86 of hub 28, allows shoulders 88 and 89 of flange 84 and rotor end 24, respectively, to place a compressive force on inner bearing races 92 and 94 of bearings 30 and 31 as a result of tightening nut and bolt, 95 and 97.

As shoulders 88 and 89 force inner races 92 and 94 toward each other in the space 93 between races 92 and 94, bearing balls 90 and 91 are forced into compressive force against the outer races 96 and 98. Collar 99 placed on hub 28 prevent bearings 30 and 31 from being placed under excessive load. Collar 99 is slightly shorter than the distance between shoulders 76,78 on the bearing housing.

Figure 9:
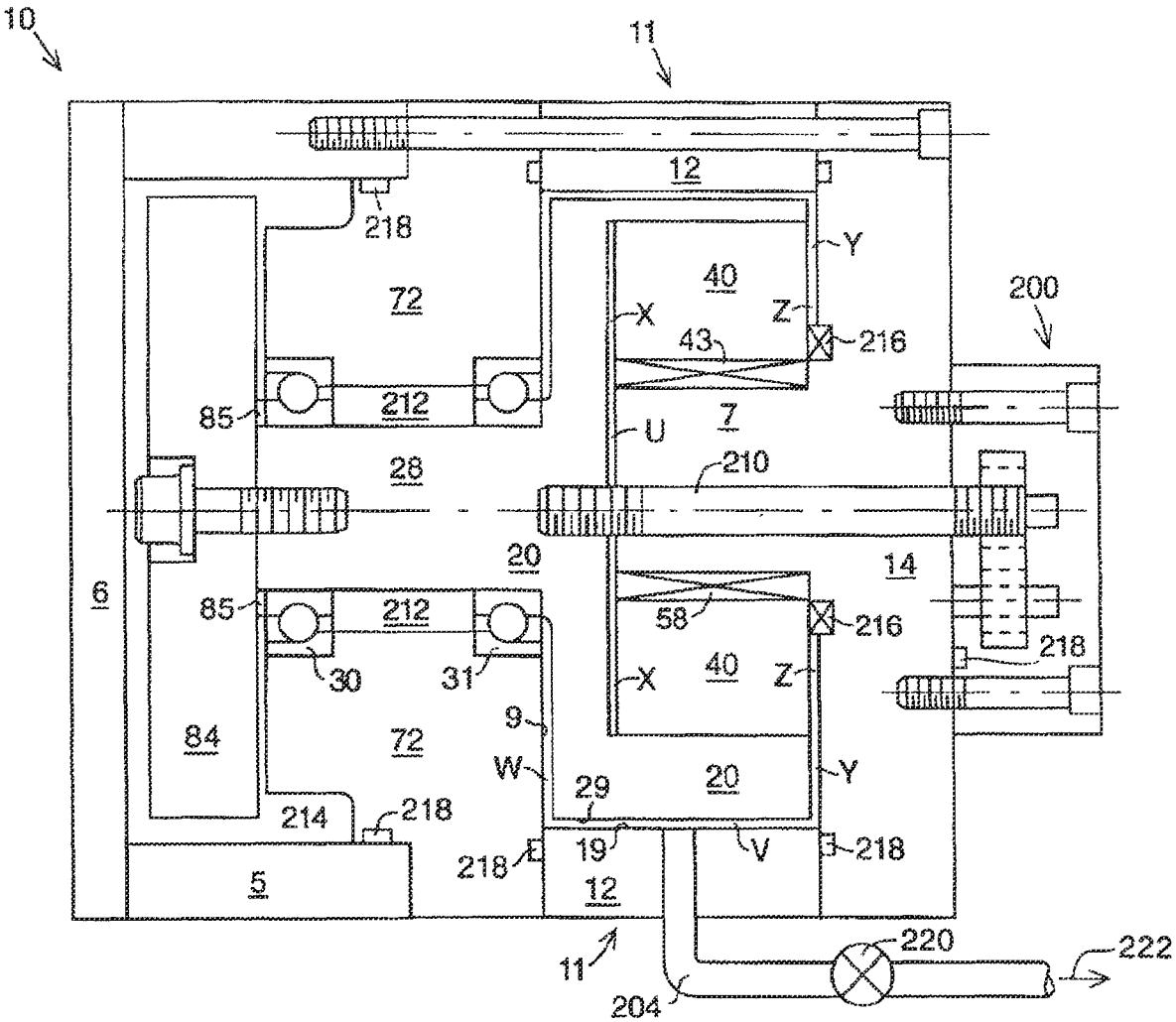
FIG. 9 is a cross-sectional view of the present invention illustrating the use of a thrust bearing to maintain a minimum inner rotor to end plate clearance, a power take-off axle from the outer rotor for use with an integrated pump and a by-pass vent and pressure control valve. Cross-sectional hatching for some parts has been eliminated for clarity and illustrative purposes.

FIGS. 5A, 6, and 9 illustrate another preloaded bearing configuration in which a preload spacer 85 replaces shoulder 88 on flange 84. Contact of flange 84 with the end of hub 28 during the pre-loading process prevents bearings 30 and 31 from being subjected to excessive load and serves a function similar to that of collar 99 in FIG. 8.

Pre-loading takes advantage of the fact that deflection decreases as load increases. Thus, pre-loading leads to reduced rotor deflection when additional loads are applied to rotor 20 over that of the pre-load condition. It is to be realized that a wide variety of pre-loaded bearing configurations can be used with this invention and that the illustrations in FIGS. 5A, 6, 8 and 9 are illustrative and not limiting as to any particular pre-loaded bearing configuration used with this invention.

By using a pair of pre-loaded bearings in bearing assembly 38, both the axial position and radial position of outer rotor 20 are set. As a result, it is possible to control the fixed-gap clearances at interfaces U, V, W and Y, that is, 1) the interface between end face 8 of hub 7 and the interior face 9 of end 24 (interface U), 2) the interface between the exterior face 27 of end plate 24 and the face 74 of housing element 72 (interface W), 3) the interface between end face 26 of rotor 20 and interior face 16 of end plate 14 (interface Y), and 4) the interface between radial edge 29 of rotor 20 and the interior radial edge 19 of housing portion 12 (interface V).

Preferably the fixed-gap clearance at interfaces V and W are maintained at a distance greater then the fluid boundary of the operating fluid used in the device 10. The fixed-gap clearance at interface Y is maintained at a distance that is a function of bypass leakage and operating fluid shear forces. The clearance at interface U is sufficient to prevent contact of the end face 8 of hub 7 with the interior face 9 of outer rotor end 24.

As shown in FIG. 5A, device 10 can be configured such that inner rotor 40 has a coaxial hub 42 extending normally and away from the rotor gear of rotor 40 with a shaft portion of hub 42 being mounted in housing 11 with bearing assembly 51. As shown, the housing of bearing assembly 51 also serves as static end plate 14 of housing 11. Bearing assembly 51 has a rolling element bearing such as ball bearing 44 or 46 that are used to set the rotational axis 52 or the axial position of rotor 40 or both. Setting the axial position of rotor 40 maintains a fixed-gap clearance between one of the surfaces of inner rotor 40 and the other rotor 20 or housing 11. Specifically, bearing assembly 51 sets the distance of the fixed-gap clearance between 1) the interior face 16 of end plate 14 and the end face 56 of inner rotor 40 (interface Z) or 2) the distance between the interior face 9 of end plate 24 of rotor 20 and the end face 54 of inner rotor 40 (interface X). Preferably the fixed-gap clearance distance at interface X or interface Z or both are maintained at an optimal distance so as to minimize both bypass leakage and operating fluid shear forces.

An appropriate bearing 44 or 46 can be selected to set the rotational axis 56 of rotor 40, e.g., a radial load rolling element bearing, or the axial position of rotor 40 within the housing, e.g., a thrust rolling element bearing. Pairs of bearings with one bearing setting the rotational axis 52 and the other bearing setting the axial position or a tapered rolling element bearing can be used to control both the axial position or rotor 40 as well as to set its rotational axis 52. Preferably a pair of pre-loaded bearings are used to set both the axial and radial position of inner rotor 40 in a manner similar to that discussed above for outer rotor 20.

Figure 5B:
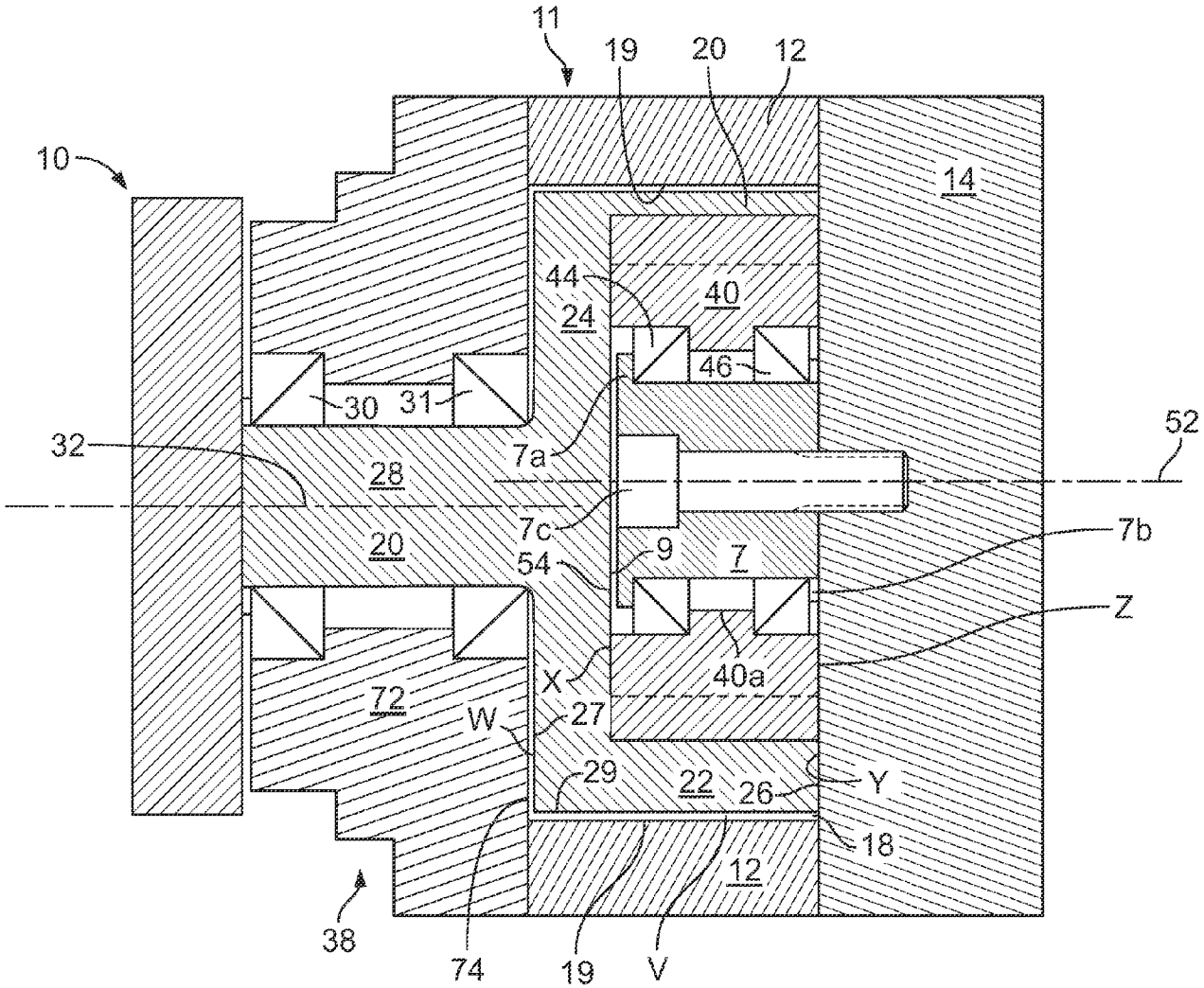
FIG. 5B is a schematic cross-sectional view of another embodiment of the present invention illustrating the use of a pre-loaded bearing assembly located within a bore of the inner rotor and utilizing a hub secured to the end plate.

FIG. 5A shows the typical configuration for a pair of pre-loaded radial ball or angular contact bearings for inner rotors of small size or narrow axial length that cannot accommodate adequate size/capacity bearings within the rotor bore. For rotors that are large enough, the coaxial hub 42 can be eliminated and a hub 7 attached to the end plate 14 is substituted. A stepped bore 40*a* is provided in the inner rotor 40, the center step providing the reaction points for the bearing preload forces. In FIG. 5B, the hub 7 has an end flange 7*a* that reacts the preload force bearing 44. A spacer 7*b* reacts the preload force from bearing 46 and determines a fixed gap clearance Z. Preload washers may be provided between the flange 7*a* and the inner race of bearing 44. A bolt 7*c* provides the preload force for the bearings and the attachment of hub 7 to the end plate 14. A single bolt is shown, but a plurality of bolts or other attachment scheme may be used.

Figure 5C:
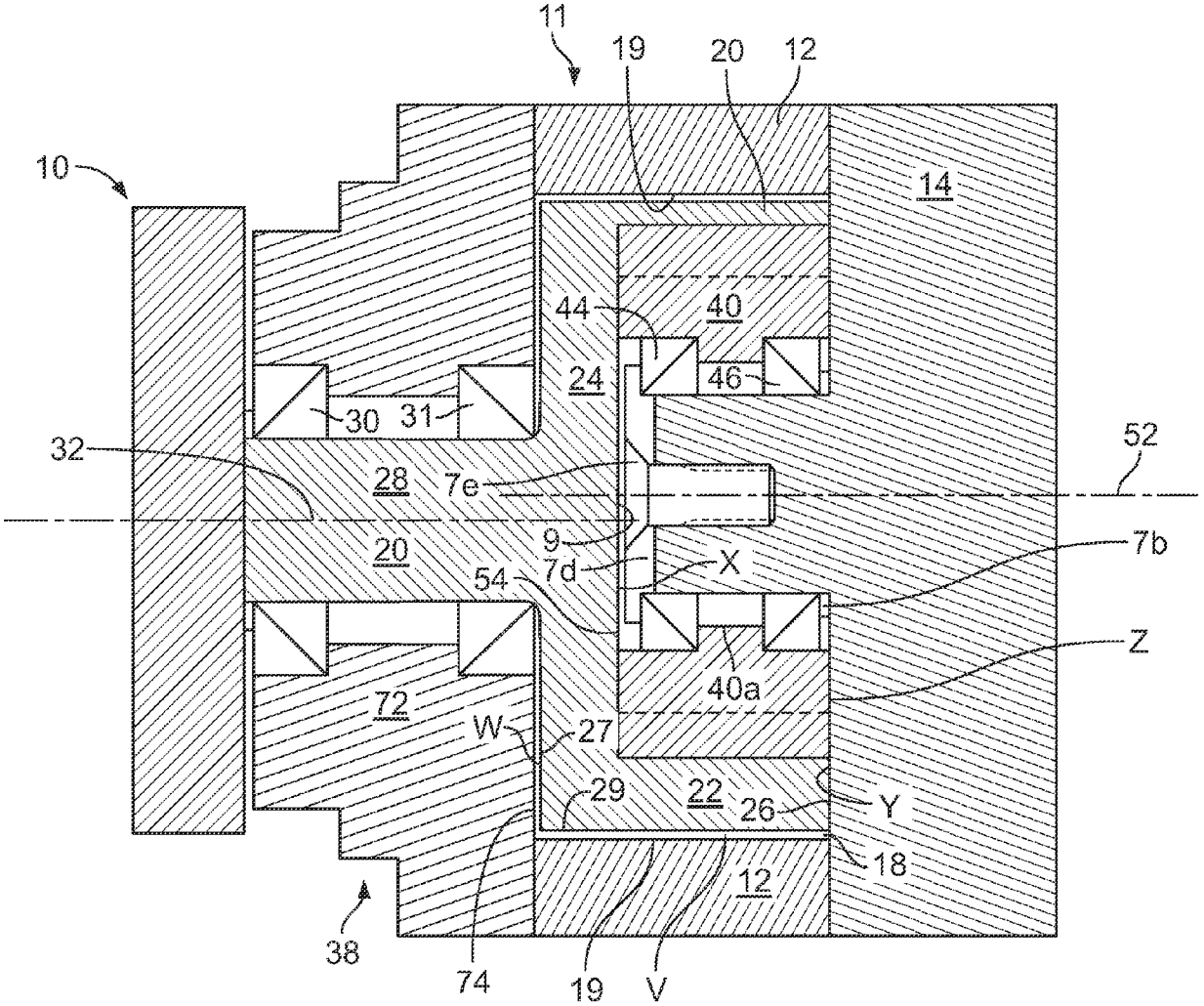
FIG. 5C is a schematic cross-sectional view of another embodiment of the present invention illustrating the use of a pre-loaded bearing assembly located within a bore of the inner rotor and utilizing a hub formed integral with the end plate.

In FIG. 5C, an alternative embodiment is depicted in which the hub 7 is integral with the end plate 14. A flanged end cap 7*d* reacts the preload force from the inner race of the bearing 44. A bolt 7*c* or other attachment scheme provides the preload force for the bearings.

As shown in FIG. 5A, an optimal configuration to reduce bypass leakage and operating fluid shear forces in the present invention includes the use of two bearing assemblies 38 and 51 with each using a pair of pre-loaded bearings to set the rotational axes and axial positions of inner rotor 40 and outer rotor 20. Such an arrangement allows for precise setting of a fixed-gap clearance at interfaces V, W, X, Y, and Z with the fixed-gap clearance at interface V and W set at a distance greater than the fluid boundary layer of the operating fluid used in device 10 and the fixed-gap clearance at interfaces X, Y, and Z set at a substantially optimal distance to minimize bypass leakage and operating fluid shear forces. The configuration in FIG. 5A is preferred over that in FIG. 6 in that the fixed-gap clearances at interfaces X, Y, and Z are un-effected by unbalanced hydraulic forces on rotors 20 and 40. Alternatively, and as shown in FIG. 9, a thrust bearing 216 can be incorporated into the basic design of FIG. 6 to more precisely control the clearance at interfaces X and Z. As operating pressure increases in the device, unbalanced hydraulic forces on inner rotor 40 tend to force it toward stationary port plate 14. If the pressure becomes sufficiently high, the hydraulic force can exceed the fluid film hydrodynamic force between rotor 40 and end plate 14 causing contact to occur. Addition of thrust bearing 216 in a groove in either the end plate 14 or in inner rotor 40, i.e., between the inner rotor 40 and plate 14 eliminates contact of the surfaces and additionally sets a minimum fixed-gap clearance at interface Z.

The embodiment shown in FIGS. 6 and 8 is perhaps the simplest configuration utilizing a preloaded pair of rolling element bearings on the outer rotor and a needle roller bearing on the inner rotor. It is practical for rotor sets of low tooth count, where the solid core diameter of the inner rotor is intrinsically small and where the pressure differential across the device is small. At low pressure differentials, gaps X and Z act as hydrodynamic film bearings and center the inner rotor in the chamber bounded by the end plate 14 and the outer rotor end plate 24.

When the embodiment shown in FIG. 9 is used as an expander, at increased differential across the device the fluid pressure forces may overcome the hydrodynamic film load capability at gap Z. A thrust bearing 216 is added to react the load and maintain the proper gap clearance. This, however, increases the complexity of the device, in addition to introducing the difficulty of manufacturing precision depth trepanned bores. Also, if a pressure reversal occurs across the device, e.g., motoring, the axial forces on the inner rotor reverse and the hydrodynamic film capability at gap X is overcome. The thrust bearing solution is not viable at this interface, since both moving parts are not co-axial, although the relative velocity between the surfaces is small.

The embodiment shown in FIGS. 4 and 5A utilizes preloaded rolling element bearings on both the inner and outer rotors and solves the potential operational problems encountered in the embodiment shown in FIGS. 6, 8, and 9. The embodiment shown in FIGS. 4 and 5A is especially suited to small devices and those of short rotor length. The fluid pressure forces in the rotor chambers create a load perpendicular to the axis of the inner rotor which is reacted as a couple on bearings 44 and 46. This necessitates more robust bearings and an adequate distance between them, which requires the end plate 14 to be thicker or an extended boss on the external surface of the plate 14 to be added to accommodate the bearings. In addition, a cover plate, which must be wider than bearing 46, is required for a sealed or high pressure device. Since the porting conduits 2, 4 for the rotor chambers are introduced through end plate 14 (FIG. 4) the bearings 44, 46 and the cover plate compete with the port access for space.

As the devices evolve to larger powers at higher pressures and pressure ratios, the embodiments shown in FIGS. 5B and 5C became the practical solution to all of the above problems. The preloaded pair of rolling element bearings of sufficient capacity can be accommodated in the bore of the inner rotor 40, thereby eliminating the induced couple and the intrusion of the bearings in the end plate 14 and the associated cover plate, thus allowing the entire area of the end plate for porting.

When used as an engine in Rankine cycle configurations, the present invention affords several improvements over turbine-type devices where condensed fluid is destructive to the turbine blade structure and, as a result, it is necessary to prevent two-phase formation when using blade-type devices. In fact, two-phase fluids can be used to advantage to increase the efficiency of the present invention. Thus when used with fluids that tend to superheat, the superheat enthalpy can be used to vaporize additional operating liquid when the device is used as an expansion engine thereby increasing the volume of vapor and furnishing additional work of expansion. For working fluids that tend to condense upon expansion, maximum work can be extracted if some condensation is allowed in expansion engine 10. When using mixed-phased fluids, the fixed-gap clearance distance must be set to minimize by-pass leakage and fluid shear loses given the ratio of liquid and vapor in engine 10.

Figure 10:
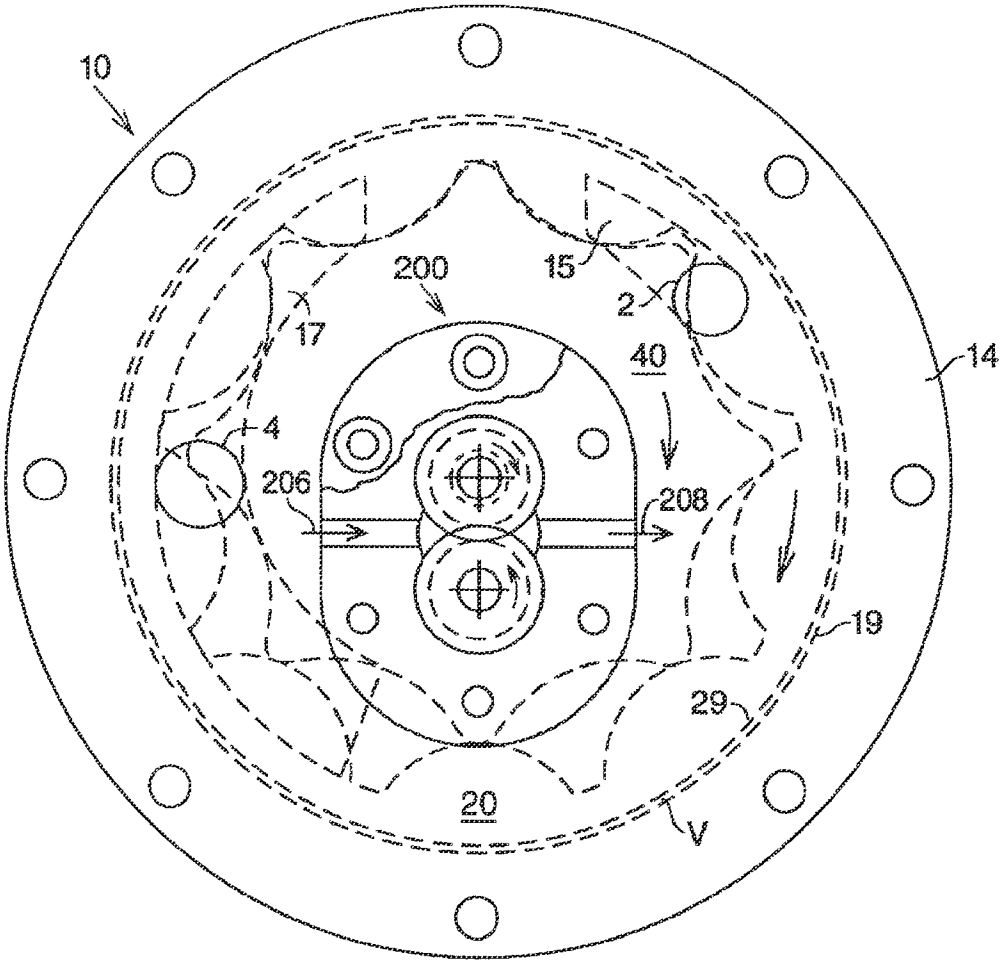
FIG. 10 is a partially cut-away end view of the embodiment of FIG. 9.
Figure 11:
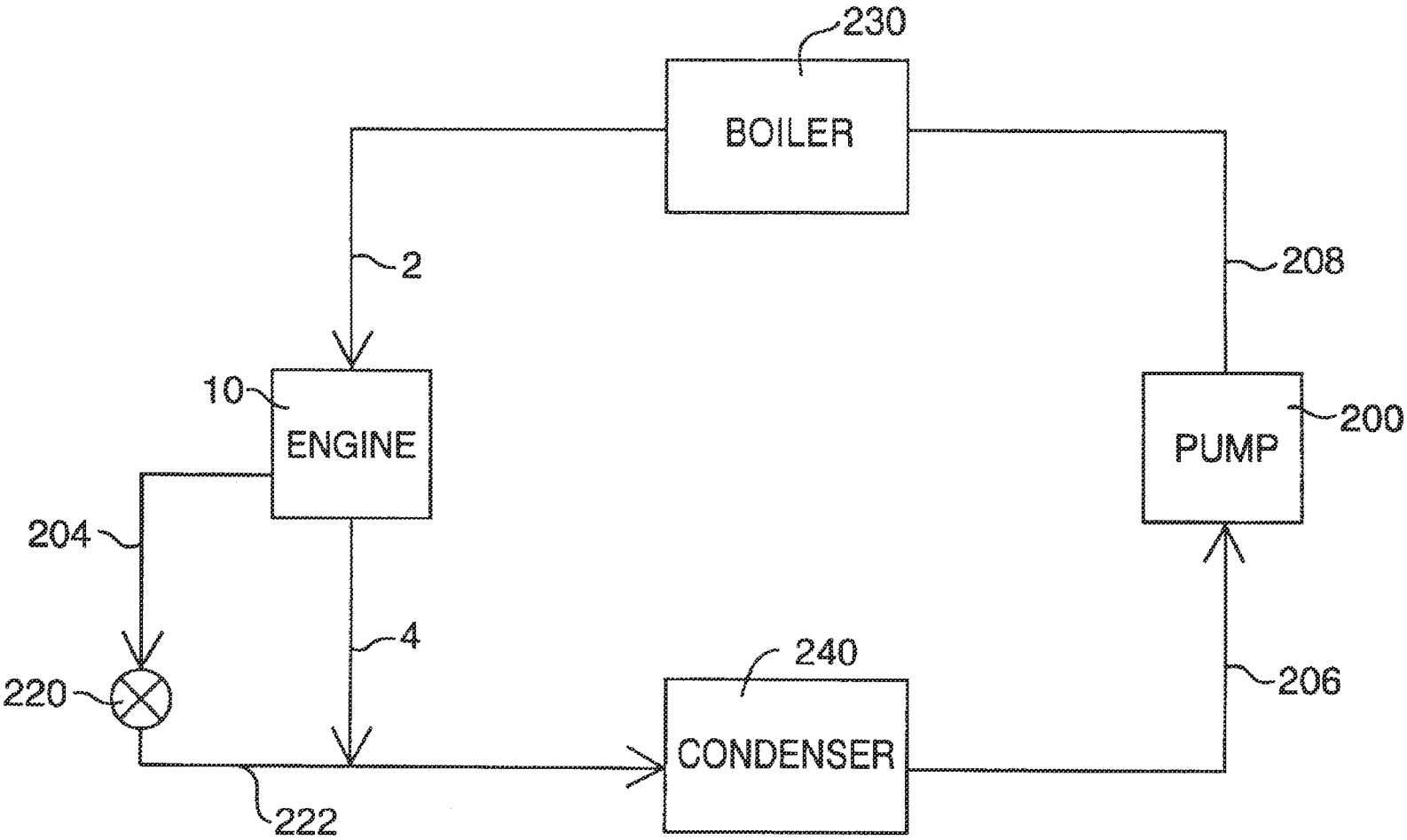
FIG. 11 is a schematic view illustrating the use of the present invention as an engine in a Rankine cycle.

FIGS. 9-11 show the present device as employed in a typical Rankine cycle. Referring to FIG. 11, high pressure vapor (including some superheated liquid) from boiler 230 serves as the motive force to drive device 10 as an engine or prime mover and is conveyed from the boiler 230 to the inlet port 15 via conduit 2. Low pressure vapor leaves the device via exhaust port 17 and passes to condenser 240 via conduit 4. Liquid is pumped from condenser 240 through line 206 by means of pump 200 to boiler 230 through conduit 208 after which the cycle is repeated.

As seen in FIGS. 9 and 10, a condensate pump 200 can be operated off of shaft 210 driven by outer rotor 20. When a "fixed" inner rotor assembly is used (FIG. 5A), the condensate pump can be driven directly by shaft 42 of the inner rotor.

The use of an integrated condensate pump 200 contributes to overall system efficiency in view of the fact that there are no power conversion losses to a pump separated from the engine. Hermetic containment of the working fluid is easily accomplished as leakage about pump shaft 210 of pump 200 is into the engine housing 11. As shown, device 10 can be easily sealed by adding a second annular housing member 5 and a second end plate 6. Alternatively housing member 5 and end plate 6 can be combined into an integral end cap (not shown). A seal on pump shaft 210 is not required and seal losses are eliminated.

Since the condensate pump 200 is synchronized with engine 10, fluid mass flow rate in Rankine type cycles is the same through the engine 10 and condensate pump 210. With engine and pump synchronized, the condensate pump capacity is exact at any engine speed thereby eliminating wasted power from using overcapacity pumps.

In typical applications, some by-pass leakage occurs at interface Y (between face 26 of the inner rotor and interior face 16 of end plate 14) into the outer extremes of the interior of housing 11, e.g., interface V and W and spaces such as void spaces 212 and 214. Such fluid build-up, especially in the fixed-gap at interfaces V and W, leads to unnecessary fluid shear losses. To eliminate such losses, a simple passage such as conduit 204 is used to communicate the interior of housing 11 with the low pressure side of device 10. Thus for an expansion engine, the housing interior is vented to the exhaust conduit 4 by means of conduit 204 (FIG. 11). Such venting also minimizes the stress on housing 11 which is of special concern when non-metallic materials are used for the construction of at least parts of housing 11 such as when device 10 is linked to an external drive by means of a coupling window, e.g., the use of a magnetic drive in plate 84 that is coupled to another magnetic plate (not shown) through non-magnetic window 6.

Typically device 10 works most efficiently when the housing interior (case chamber) pressure is maintained between the inlet and exhaust pressures. A positive pressure in the case negates part of the bypass leakage at interface Y. Housing seals 218 are used as appropriate. A pressure control valve, such as an automatic or manual throttle valve 220, allows for optimization of the housing pressure for maximum operating efficiency.

The sizing of the components of the device 10 is generally dictated by the requirements of the application, particularly the fluid pressure range. More specifically, applications utilizing fluids under higher pressure require higher capacity (and typically larger) inner rotor bearings 44, 46. Rotor speed is also an important factor, to ensure that the rolling elements in the bearings roll and do not slide or skid. For example, in one embodiment, the device with the inner rotor of FIG. 5B or FIG. 5C may be configured for use in a cycle for extracting energy from a waste heat fluid stream. The fluid may have an inlet temperature of about 210° F. at a pressure of approximately 250 psi. The bearings 44, 46 may fit in the inner rotor having a bore diameter of approximately two inches, the sizing being driven primarily by the fluid pressure and associated loading on the bearings. In this embodiment, the inner rotor 40 may have eight lobes and the outer rotor 20 nine lobes. The fluid enters the inlet passage 15, driving the inner rotor 40 relative to the outer rotor 20, and exits the outlet passage 17 at a substantially lower temperature, for example at about 150° F. to about 160° F., resulting in a temperature differential of about 50° F. to 60° F. The inner rotor 40 and the outer rotor 20 may be driven at about 3700 rpm to match roughly the synchronous 3600 rpm speed of a two-pole electrical generator plus slip. The flow rate through the device 10 may be dependent upon the fluid used. The invention is not intended to be limited to these dimensions or operational parameters, as they are only being presented to illustrate one possible embodiment.

It is possible that changes in configurations to other than those shown could be used but that which is shown if preferred and typical. Without departing from the spirit of this invention, various means of fastening the components together may be used.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

What is claimed is:

1. A rotary chambered fluid energy-transfer device comprising:

(a) a housing comprising:
  (1) a central portion having a central portion bore formed therein; and
  (2) an end plate having an inlet passage and an outlet passage;

(b) an outer rotor rotatable in the central portion bore, the outer rotor comprising:
  (1) a female gear profile formed in a radial portion;
  (2) a first end covering the female gear profile;
  (3) a second end skirting the female gear profile; and
  (4) an outer rotor hub extending from the first end and mounted in the housing with a first bearing assembly comprising a rolling element bearing; and (c) an inner rotor with a male gear profile in operative engagement with the outer rotor and having an inner rotor bore formed therein, the inner rotor mounted in the housing with a second bearing assembly comprising a first rolling element bearing and a second rolling element bearing mounted in a pre-loaded configuration with each other in the inner rotor bore by attachment means, wherein the first bearing assembly and the second bearing assembly:
  1) set at least one of:
    a) a rotational axis of the inner rotor;
    b) a rotational axis of the outer rotor;
    c) an axial position of the inner rotor; and
    d) an axial position of the outer rotor; and
  2) maintain a fixed-gap clearance of at least one of the inner rotor and the outer rotor with at least one surface of:
    a) the housing; and
    b) the other rotor.

2. The fluid energy-transfer device of claim 1, wherein the fixed-gap clearance is a distance greater than a fluid boundary layer of an operating fluid used in the fluid energy-transfer device.

3. The fluid energy-transfer device of claim 1, wherein the fixed-gap clearance is a substantially optimal distance as a function of bypass leakage and operating fluid shear forces.

4. The fluid energy-transfer device of claim 1, wherein the fluid energy-transfer device is adapted for use as a prime mover.

5. The fluid energy-transfer device of claim 4, wherein a pressurized operating fluid is used in the fluid energy-transfer device to provide a motive force.

6. The fluid energy-transfer device of claim 5, wherein the inlet passage and the outlet passage of the end plate are configured for optimum expansion of the pressurized fluid in the fluid energy-transfer device.

7. The fluid energy-transfer device of claim 5, wherein the pressurized fluid is in both a gaseous state and a liquid state.

8. The fluid energy-transfer device of claim 5, wherein the pressurized fluid is in a gaseous state.

9. The fluid energy-transfer device of claim 4, further comprising an integrated condensate pump driven from an output shaft of the fluid energy-transfer device.

10. The fluid energy-transfer device of claim 1, wherein the fluid energy-transfer device is hermetically sealed.

11. The fluid energy-transfer device of claim 1, wherein the fluid energy-transfer device is magnetically coupled with an external rotational shaft.

12. The fluid energy-transfer device of claim 1, further comprising a conduit for venting operating fluid from an internal housing cavity.

13. The fluid energy-transfer device of claim 12, wherein the operating fluid is vented to said outlet passage.

14. The fluid energy-transfer device of claim 12, with the conduit further comprises a pressure regulating valve.

15. The fluid energy-transfer device of claim 1, wherein the fluid energy-transfer device is adapted for use as a compressor.

16. The fluid energy-transfer device of claim 15, wherein the inlet passage and the outlet passage of the end plate are configured for optimum compression of the fluid.

17. The fluid energy-transfer device of claim 1, wherein the second bearing assembly is mounted on a housing hub of the housing.

18. The fluid energy-transfer device of claim 17, wherein the housing hub is integral with the end plate.

19. The fluid energy-transfer device of claim 18, further comprising an end cap attached to the housing hub with the attachment means to preload the second bearing assembly.

20. The fluid energy-transfer device of claim 17, wherein the housing hub is attached to the end plate with the attachment means.

21. The fluid energy-transfer device of claim 20, wherein the housing hub comprises an end flange to preload the second bearing assembly.

22. The fluid energy-transfer device of claim 1, wherein the first bearing assembly further comprises a second rolling element bearing mounted in a pre-loaded configuration.

* * * * *